United States Patent [19]

Alford et al.

[11] 4,358,366

[45] Nov. 9, 1982

[54] CATALYTIC HYDROCOKING OF RESIDUA

[75] Inventors: Harvey E. Alford, Amherst; Robert A. Rightmire, Northfield, both of Ohio

[73] Assignee: Standard Oil Company (Ohio), Cleveland, Ohio

[21] Appl. No.: 80,831

[22] Filed: Oct. 1, 1979

[51] Int. Cl.[3] ..... C10G 47/12

[52] U.S. Cl. ..... 208/112; 208/254 H; 208/216; 208/108

[58] Field of Search ..... 208/108, 112, 50–53, 208/56–59, 106–107, 113, 124, 131, 132

[56] References Cited

U.S. PATENT DOCUMENTS

| | | | |
|---|---|---|---|
| 2,727,853 | 12/1955 | Hennig | 208/53 |
| 2,844,520 | 7/1958 | Viland | 208/114 |
| 2,885,350 | 5/1959 | Brown et al. | 208/127 |
| 2,888,395 | 5/1959 | Henny | 208/111 |
| 3,131,142 | 4/1964 | Mills | 208/108 |
| 3,475,323 | 10/1969 | Stuckey et al. | 208/97 |
| 3,663,429 | 5/1972 | Vallino | 208/108 |
| 4,169,041 | 9/1979 | Schuette | 208/108 |
| 4,178,227 | 12/1979 | Metrailer et al. | 208/50 |
| 4,204,943 | 5/1980 | Metrailer et al. | 208/50 |

*Primary Examiner*—Curtis R. Davis
*Assistant Examiner*—G. E. Schmitkons
*Attorney, Agent, or Firm*—William A. Heidrich; Herbert D. Knudsen; Larry W. Evans

[57] ABSTRACT

Yields of liquid product produced by coking a feed material comprising a mixture of a shale oil material, a petroleum residuum and a hydrocracking catalyst, are enhanced by feeding hydrogen to the reaction system during the coking operation.

9 Claims, No Drawings

CATALYTIC HYDROCOKING OF RESIDUA

BACKGROUND OF THE INVENTION

The present invention represents an improvement over the invention described in commonly assigned application Ser. No. 080,832 filed Oct. 1, 1979.

Commonly assigned application Ser. No. 080,830, the disclosure of which is incorporated herein by reference, describes a coking process wherein a mixture of a shale oil material and a petroleum residuum is used as the coker feed. As pointed out in that disclosure, it has been found that the yields of liquid product obtained when such a mixture is used as the feed is greater than would have been expected.

In commonly assigned application Ser. No. 080,832, the disclosure of which is incorporated herein by reference, an improvement over the invention described in Ser. No. 080,830 is disclosed. In accordance with this improvement, the yields of liquid product can be further enhanced by including in the feed mixture a hydrogen transfer catalyst, a hydrogenation catalyst and/or a hydrocracking catalyst.

In accordance with the present invention, it has been found that the liquid yields can be increased over and above that obtained when using the improvement described in application Ser. No. 080,832 by further appropriate processing. Accordingly, it is an object of the present invention to provide an improved process for coking mixtures of a shale oil material and a petroleum residuum wherein the amount of liquid product is even greater.

SUMMARY OF THE INVENTION

This and other objects are accomplished by the present invention which is based on the discovery that the liquid yields produced by coking a mixture of a shale oil material and a petroleum residuum can be increased over and above that obtained in the previously mentioned applications by the expedient of feeding hydrogen to the material undergoing coking and using as the catalyst a hydrocracking catalyst.

Thus, the present invention provides an improvement in the process for coking a feed material comprising a mixture of a shale oil material and a petroleum residuum in which the feed material is heated in the substantial absence of oxygen to produce coke and a liquid product, the improvement in accordance with the invention wherein the feed material contains a hydrocracking catalyst, and hydrogen is fed to the reaction system during the coking operation.

It has also been found in accordance with the invention that shale oil itself or a shale oil residuum can be processed to yield a higher amount of liquid product than otherwise expected by feeding hydrogen to the material undergoing coking and including a hydrocracking catalyst in the reaction system.

Thus, the present invention also provides a process for coking a shale oil material to produce coke and liquid product, the process comprising heating the shale oil material in the substantial absence of oxygen and supplying hydrogen to the reaction system whereby the liquid product and coke form, the shale oil material containing a hydrocracking catalyst.

DETAILED DESCRIPTION

Feed Materials

The feed materials employed in the inventive process can be the same as those employed in the invention described in the aforementioned commonly assigned application Ser. No. 080,832. In addition, in the inventive process whole shale oil or a shale oil residuum can be used as the feed material.

Normally, the feed material will be a mixture of a shale oil material and a petroleum residuum in which the shale oil material is present in an amount of 5 to 85, preferably 15 to 50 weight percent. Moreover, while whole shale oil can be used as the shale oil material, it is preferable that a shale oil residuum comprising no more than the bottom 60% of whole shale oil be employed.

Catalysts

The catalyst employed in the inventive process is a hydrocracking catalyst. These catalysts are more thoroughly described in the aforementioned Ser. No. 080,832. Hydrogen transfer catalysts as well as hydrogenation catalysts which are described as useful in the aforementioned Ser. No. 080,832 can be included in the reaction system of the present invention. In this event, however, it is still necessary to include a hydrocracking catalyst in the reaction system.

Examples of hydrocracking catalysts which have been found to be especially useful in accordance with the present invention are NiMo, NiW, CoMo and CoW. Such catalysts are usually supported on alumina. Of these catalysts, NiMo and NiW supported on alumina are especially preferred.

The amount of hydrocracking catalyst to be included in the reaction system can vary widely. Broadly, the amount of hydrocracking catalyst can be between greater than 0 to 10 weight percent. More preferably, the amount of cracking catalyst is between 0.01 to 5 weight percent with amounts on the order of 0.05 to 1 weight percent being most preferred.

Coking Procedure

Coking is accomplished in a conventional manner in accordance with the present invention with the exception that hydrogen is supplied to the reaction system during the coking operation.

Hydrogen can be supplied to the reaction system in any convenient manner. Most conveniently, suitable inlet orfices will be provided in the coking apparatus for the advent of the hydrogen. Since it is preferable that the hydrocracking catalyst be reasonably well mixed in the reaction system during the coking operation, it is preferred that the hydrogen be introduced so as to cause turbulence of the liquid reaction system, thereby causing significant mixing. The hydrogen can be introduced in other ways, of course, in which case it is preferable to provide other means, e.g. mechanical stirrer, for causing mixing of the liquid reaction system. Hydrogen may also be produced in situ in the reactor by feeding steam thereto, the steam reacting with the coke and/or light hydrocarbons in the system to generate hydrogen.

The amount of hydrogen fed to the reaction system can also vary over wide limits. Broadly, the total amount of hydrogen supplied during a particular coking operation can be 2 to 30 SCF/lbs liquid feed. Preferably, the amount of hydrogen fed is 5 to 15, most preferably 12 to 15, SCF/lbs liquid feed.

Although the inventive process can be carried out at widely varying pressures, it is preferred to operate at conventional coking pressures, i.e. greater than 0 to about 100 psig. Such pressures it will be noted are much less than occurring in conventional petroleum hydrocracker units wherein the pressure is on the order of 2,000 psig. Preferred operating pressures in the inventive process are on the order of 25 to 90 psig. If desired, inert gases such as nitrogen can also be included in the reaction system.

WORKING EXAMPLES

In order to more thoroughly describe the present invention, the following working examples are presented. The data presented in these examples was obtained in a benchscale, batch mini-coker comprising a carbon steel cylindrical container having an inside diameter of 4 inches and an internal height of 21 inches. In the mini-coker, the nominal charge of feed material is 2,000 g. In these tests where a catalyst was used, the catalyst was first pulverized and mixed with the feed material prior to its introduction into the mini-coker. To keep the catalyst suspended, a stream of gas was introduced at the base of the coker. The pressure was maintained at 25 psig for all tests. The program temperature cycle, shown in Table I below, was developed specifically for use with vacuum tower bottoms.

TABLE I

| TIME AT TEMPERATURE IN THE MINI-COKER | |
|---|---|
| Temp, °F. | Time, Minutes |
| 600 | 45 |
| 800 | 45 |
| 900 | 30 |
| 1,000 | 30 |
| 1,100 | 30 |
| 1,200 | 90 |

Temperature changes were made as rapidly as possible. The total elapsed time generally ranged from 6.5 to 7 hours. The overhead (distillate) line was heated to 650° F. prior to the start of each test to minimize reflux (recycle). The volume of the offgas was measured and samples were taken at regular intervals for analysis. Hydrogen and nitrogen were calculated out of the gas analysis when they were used to suspend the catalyst. In those tests in which a catalyst was used, its weight was not included in material balance calculations. Since the volatile matter remaining in the coke could vary over rather wide limits, the yields of coke were generally calculated on a 0 VCM basis. This volatile was included in the liquid product as was the $C_4+$ material in the gas stream for material balance purposes.

EXAMPLES 1 TO 3 AND COMPARATIVE EXAMPLES A AND B

Whole shale oil was coked in a mini-coker while the gas, usually hydrogen, was fed to the coker. In Examples 1 to 3, three different hydrocracking catalysts were included in the feed mixture. In Comparative Examples A and B, no catalyst was included in the system. The identity of the catalysts and the results obtained are set forth in the following Table II.

TABLE II

| EFFECT OF HYDROCRACKING CATALYST Feed: Whole Shale Oil | | | | | |
|---|---|---|---|---|---|
| | Comp A | Comp B | 1 | 2 | 3 |
| Example | | | | | |
| Catalyst* | None | None | 2.9% Ni 17.5% Mo | 4.1% Ni 13.3% Mo | 2.7% Ni 50.3% W |
| Wt. % | — | — | 1.00 | 1.00 | 1.00 |
| Suspending Gas | $N_2$ | $H_2$ | $H_2$ | $H_2$ | $H_2$ |
| Products | | | | | |
| Wt. % Liquid ($C_4^{30}$) | 79.17 | 77.42 | 82.04 | 84.05 | 84.56 |
| Wt. % Coke (0 VCM)** | 10.15 | 9.31 | 8.65 | 6.43 | 9.93 |
| Products, % S | | | | | |
| Liquid | 0.65 | 0.68 | 0.63 | 0.61 | 0.65 |
| Coke | 0.49 | 0.47 | 2.27 | 0.80 | 0.43 |
| Liquid + Coke | 0.63 | 0.65 | 0.86 | 0.64 | 0.62 |
| Products, % N | | | | | |
| Liquid | 2.21 | 2.48 | 2.22 | 2.26 | 2.26 |
| Coke | 3.77 | 3.82 | 3.73 | 3.32 | 3.50 |
| Liquid + Coke | 2.42 | 2.69 | 2.43 | 2.41 | 2.43 |

*Supported on alumina.
**Catalyst weight not included.

From the foregoing, it can be seen that all three hydrocracking catalysts show increased liquid product yields when hydrogen is added. Without a catalyst, hydrogen had no beneficial effect. None of the catalysts had any significant effect on product sulfur and nitrogen.

EXAMPLES 4 TO 6 AND COMPARATIVE EXAMPLES C AND D

Examples 1 and 3 and Comparative Examples A and B were repeated except that the feed consisted of a mixture of 50% whole shale oil and 50% vacuum tower bottoms. The identity of the catalysts as well as results obtained are set forth in the following Table III.

TABLE III

| EFFECT OF HYDROCRACKING CATALYST Feed: 50 Wt. % Whole Shale Oil, 50 Wt. % Vacuum Bottoms | | | | | |
|---|---|---|---|---|---|
| | Comp C | Comp D | 4 | 5 | 6 |
| Example | | | | | |

TABLE III-continued

| EFFECT OF HYDROCRACKING CATALYST Feed: 50 Wt. % Whole Shale Oil, 50 Wt. % Vacuum Bottoms | | | | | |
|---|---|---|---|---|---|
| | Comp C | Comp D | 4 | 5 | 6 |
| Catalyst* | None | None | 2.9% Ni 17.5% Mo | 4.1% Ni 13.3% Mo | 2.7% Ni 50.3% W |
| Wt. % | — | — | 1.00 | 1.00 | 1.00 |
| Suspending Gas | $N_2$ | $H_2$ | $H_2$ | $H_2$ | $H_2$ |
| Products | | | | | |
| Wt. % Liquid ($C_4$+) | 73.74 | 73.75 | 79.63 | 76.28 | 76.74 |
| Wt. % Coke (0 VCM)** | 15.34 | 15.81 | 14.50 | 13.87 | 13.85 |
| Products, % S | | | | | |
| Liquid | 0.57 | 0.64 | 0.62 | 0.62 | 0.62 |
| Coke | 2.00 | 2.01 | 1.95 | 1.91 | 1.98 |
| Liquid + Coke | 0.96 | 0.97 | 0.93 | 0.92 | 0.94 |
| Products, % N | | | | | |
| Liquid | 1.30 | 1.31 | 1.31 | 1.41 | 1.37 |
| Coke | 1.49 | 1.71 | 1.58 | 1.58 | 1.67 |
| Liquid + Coke | 1.35 | 1.41 | 1.37 | 1.45 | 1.44 |

*Supported on alumina.
**Catalyst weight not included.

From the foregoing, it can be seen that hydrogen without a catalyst has no effect on liquid product yields. All three catalysts, however, result in increased liquid yields when hydrogen is added to the coking mixture. Total product sulfur also decreased, but product nitrogen remained essentially the same.

EXAMPLES 7 TO 10

A feed mixture comprising 50 weight percent whole shale oil and 50 weight percent vacuum tower bottoms was coked in the mini-coker while about 1 liter/min. $H_2$ gas was fed thereto. The reaction pressure was 25 psig. In each example, a catalyst comprising 2.9% Ni, 17.5% Mo was used, the amount of catalyst in the feed mixture being varied. The amount of catalyst in each example and the results obtained are set forth in the following Table IV.

TABLE IV

| EFFECT OF HYDROCRACKING CATALYST CONCENTRATION Feed: 50 Wt. % Whole Shale Oil, 50 Wt. % Vacuum Bottoms, Suspending Gas: $H_2$ | | | | |
|---|---|---|---|---|
| | 7 (4) | 8 | 9 | 10 |
| Example | | | | |
| Wt. % Catalyst | 1.00 | 0.50 | 0.25 | 0.05 |
| Products | | | | |
| Wt. % Liquid ($C_4$+) | 79.63 | 77.79 | 78.83 | 78.78 |
| Wt. % Coke (0 VCM)* | 14.50 | 15.41 | 12.90 | 13.35 |
| Products, % S | | | | |
| Liquid | 0.62 | 1.06 | 0.63 | 0.66 |
| Coke | 1.95 | 3.28 | 1.79 | 2.05 |
| Liquid + Coke | 0.93 | 1.63 | 0.91 | 0.99 |
| Products, % N | | | | |
| Liquid | 1.31 | 1.44 | 1.43 | 1.32 |
| Coke | 1.58 | 2.04 | 1.75 | 1.79 |
| Liquid + Coke | 1.37 | 1.59 | 1.51 | 1.43 |

*Catalyst weight not included.

As can be seen, very low concentrations of catalysts are effective when hydrogen is also supplied to the reaction system. Yield structure and product sulfur and nitrogen were very similar when using from 0.05 to 1.00 weight percent hydrocracking catalyst.

EXAMPLES 11 AND 12

In one embodiment of the invention, used catalysts can be recycled for reuse. Example 12 illustrates this procedure, while Example 11 using fresh catalyst is presented for purposes of comparison. In Examples 11 and 12 the feed consisted of 50 weight percent whole shale oil and 50 weight percent vacuum bottoms together with 1.00 weight percent catalyst. In example 11, fresh catalyst was employed and the feed was coked to produce a liquid product and coke. The coke product of Example 11 was removed from the coker and combusted in air to produce an ash product containing used catalyst. Enough ash product was added to an additional amount of feed material so that the catalyst content thereof was one weight percent. This feed material was then coked again as Example 12. The results obtained are set forth in the following Table V.

TABLE V

| EFFECT OF RECYCLING HYDROCRACKING CATALYST Feed: 50 Wt. % Whole Shale Oil, 50 Wt. % Vacuum Bottoms, Suspending Gas: $H_2$ | | |
|---|---|---|
| | 11 (5) | Catalyst: 12 |
| Example | | |
| Catalyst (4.1% Ni, 13.3% Mo) | Fresh | Recycled |
| % Active (based on fresh feed) | 1.00 | 1.00 |
| Products | | |
| Wt. % Liquid ($C_4$+) | 76.28 | 74.97 |
| Wt. % Coke (0 VCM)* | 13.87 | 16.24 |
| Products, % S | | |
| Liquid | 0.62 | 1.09 |
| Coke | 1.91 | 3.55 |
| Liquid + Coke | 0.92 | 1.75 |
| Products, % N | | |
| Liquid | 1.41 | 1.46 |
| Coke | 1.58 | 2.09 |
| Liquid + Coke | 1.45 | 1.63 |

*Catalyst weight not included.

It will be noted that the yield structures of Examples 12 and 12 are quite similar, although the recycled catalyst gave slightly less liquid and more coke. The recycled catalyst does result in higher product sulfur and nitrogen.

EXAMPLES 13 AND 14

Examples 11 and 12 were repeated except that coke produced in Example 11 was used in Example 14 without burning to produce an ash. In other words, the coke products of Example 13 was used as is as the catalyst source. Also, the amount of coke added to the feed of Example 14 was such that the amount of catalyst therein was 0.34 weight percent rather than 1.00 weight percent. The results obtained are set forth in the following Table VI.

TABLE VI

EFFECT OF RECYCLING COKE CONTAINING HYDROCRACKING CATALYST
Feed: 50 Wt. % Whole Shale Oil, 50 Wt. % Vacuum Bottoms, Suspending Gas: $H_2$

| | 13 | 14 |
|---|---|---|
| Example | | |
| Catalyst (2.9% Ni, 17.5% Mo) | Fresh | Recycled |
| % Active (based on fresh feed) | 1.00 | 0.34 |
| Products | | |
| Wt. % Liquid ($C_4$+) | 79.63 | 79.32 |
| Wt. % Coke (0 VCM)* | 14.50 | 19.97 |
| Products, % S | | |
| Liquid | 0.62 | 0.63 |
| Coke | 1.95 | 1.92 |
| Liquid + Coke | 0.93 | 0.97 |
| Products, % N | | |
| Liquid | 1.31 | 1.35 |
| Coke | 1.58 | 1.62 |
| Liquid + Coke | 1.37 | 1.42 |

*Catalyst weight not included.

As can be seen, liquid yields are same whether fresh or recycled catalyst is used. Coke yield is somewhat higher in the case of recycled catalyst. Also, product sulfur and nitrogen are also slightly higher with recycled catalyst.

Although only a few embodiments of the present invention have been described above, it should be appreciated that many modifications can be made without departing from the spirit and scope of the invention. All such modifications are intended to be included within the scope of the present invention, which is to be limited only by the following claims.

We claim:

1. A process for delayed coking a shale oil material to produce coke and liquid product, said process comprising heating said shale oil material in the substantial absence of oxygen and supplying hydrogen to said reaction system whereby said liquid product and coke form, said shale oil material containing a hydrocracking catalyst.

2. The process of claim 1 wherein said shale oil material contains greater than 0 to 10 weight percent hydrocracking catalyst.

3. The process of claim 2 wherein said shale oil material comprises whole shale oil.

4. The process of claim 3 wherein said shale oil material comprises the bottom 60% or less of whole shale oil.

5. In a process for delayed coking a feed material comprising a mixture of a shale oil material and a petroleum residuum in which said feed material is heated in the substantial absence of oxygen to produce coke and a liquid product, the improvement wherein said feed material contains a hydrocracking catalyst, and hydrogen is fed to the reaction system during the coking operation.

6. The process of claim 5 wherein said feed material contains greater than 0 to 10 weight percent hydrocracking catalyst.

7. A process for delayed coking a shale oil material to produce coke and in a liquid product, the process comprising heating the shale oil material in the substantial absence of oxygen and supplying hydrogen to the reaction system in which a liquid product and coke form, the shale oil material containing a hydrocracking catalyst from the group consisting of NiMo, NiW, CoMo and CoW.

8. The process of claim 7 in which the hydrocracking catalyst is selected from NiMo and NiW.

9. The process of claims 1, 5, or 7 in which the process is conducted at a temperature from about 600° F. to about 1000° F. and a pressure greater than 0 up to about 100 psig.

* * * * *